United States Patent [19]

Chirico

[11] 4,105,065

[45] Aug. 8, 1978

[54] HEAT EXCHANGER

[75] Inventor: Anthony Nicholas Chirico, Short Hills, N.J.

[73] Assignee: Ecodyne Corporation, Lincolnshire, Ill.

[21] Appl. No.: 774,841

[22] Filed: Mar. 7, 1977

[51] Int. Cl.[2] ..... F28F 9/02

[52] U.S. Cl. ..... 165/78; 165/137; 165/158

[58] Field of Search ..... 165/78, 158, 160, 175, 165/176, 137

[56] References Cited

U.S. PATENT DOCUMENTS

| | | | |
|---|---|---|---|
| 1,672,650 | 6/1928 | Lonsdale | 165/160 |
| 1,862,707 | 6/1932 | Rifenberick et al. | 165/137 X |
| 2,900,173 | 8/1959 | Pickford | 165/158 X |
| 3,151,674 | 10/1964 | Heller et al. | 165/158 |

*Primary Examiner*—Albert W. Davis, Jr.
*Attorney, Agent, or Firm*—Charles M. Kaplan; Joel E. Siegel

[57] ABSTRACT

A heat exchanger employs a variable number of repositionable baffles in its headers to permit changing the number of passes made by the fluid processed therein.

11 Claims, 6 Drawing Figures fig.1.
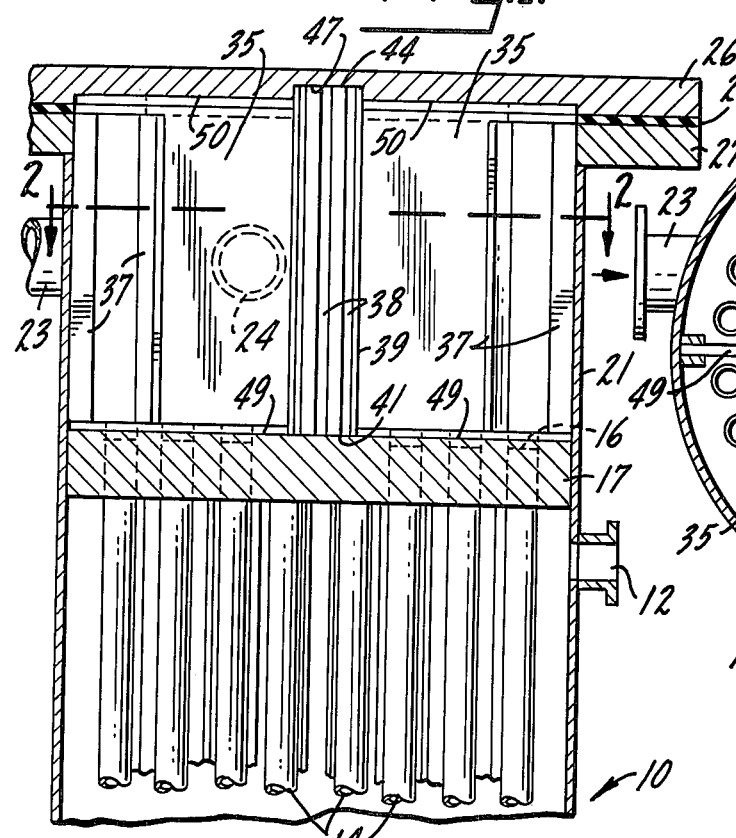
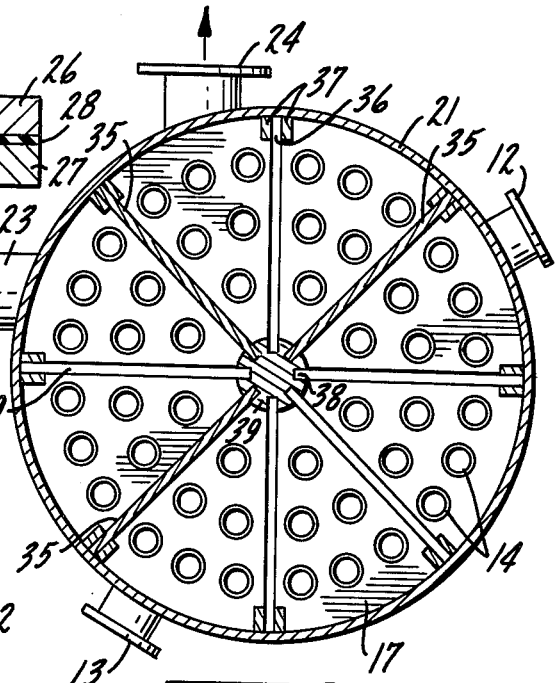
fig.2.
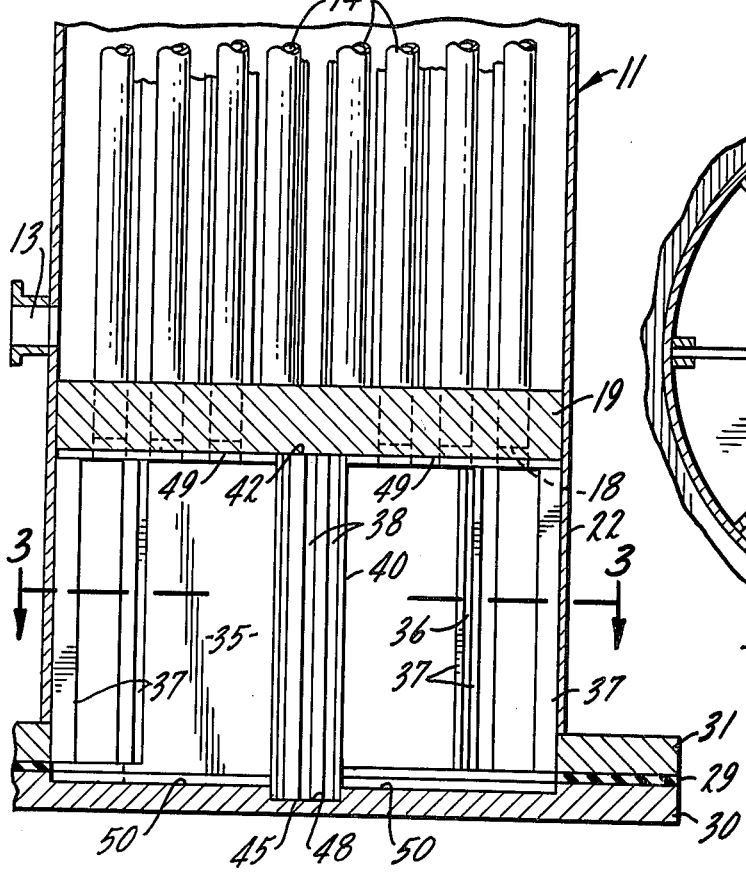
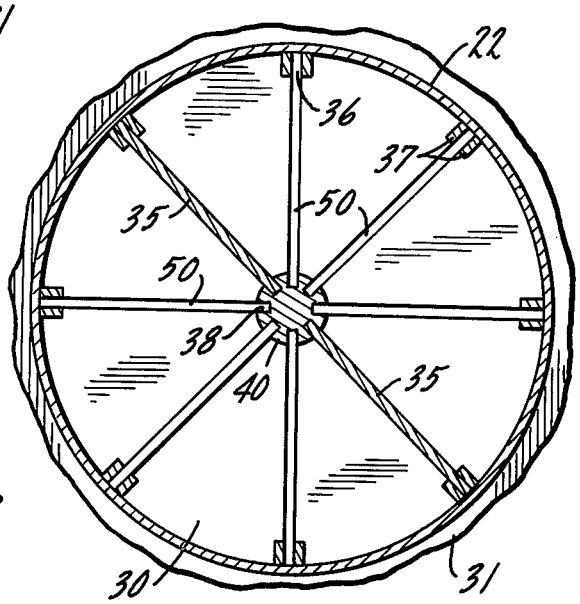
fig.3.

HEAT EXCHANGER

BACKGROUND OF THE INVENTION

Sometimes the optimum flow conditions for a fluid passing through a heat exchanger can not be determined until after the heat exchanger is put into operation. For example, when concentrating radioactive waste liquors which have a predominant scaling tendency, it is advantageous to heat such liquors at as high a velocity as is practical. But the optimum velocity for minimum power consumption consistent with maintaining scale-free operation is often unknown. In addition, future operations may include crystallization of salts from the concentrated liquors, and it may be impossible to predetermine the optimum velocity for minimizing erosion and extending tube life when operating as a crystallizer. Thus it is desirable to be able to change the velocity of the fluid flowing through the heat exchanger after the exchanger has been installed and operated. This can most easily be accomplished by changing the number of passes the fluid being heated makes through the tubes of the exchanger. Such flexibility was not easily attained with prior art apparatus in that extensive and costly modification of the equipment or excessive down time was required.

OBJECTS OF THE INVENTION

Accordingly, it is an object of this invention to provide an improved heat exchanger.

Another object is to provide a heat exchanger in which the velocity of the fluid being heated can be readily varied Another object is to provide a variable pass heat exchanger in which the number of passes made by the fluid being heated can be changed without requiring basic structural modification of the exchanger.

Another object is to provide a heat exchanger in which the number of passes can be doubled or halved.

Another object is to provide a heat exchanger for processing radioactive waste in which the time needed to change flow characteristics is minimized thereby reducing exposure of personnel to radioactivity.

Another object is to provide a variable pass heat exchanger that is relatively efficient, durable, simple to adjust and maintain, and which does not possess defects found in similar prior art apparatus.

Other objects and advantages of the invention will be revealed in the specification and claims, and the scope of the invention will be set forth in the claims.

DESCRIPTION OF THE DRAWING

FIG. 1 is a partially broken-away, cross sectional, side view of a heat exchanger in accord with this invention.

FIG. 2 is a cross sectional view taken along the line 2—2 of FIG. 1.

FIG. 3 is a cross sectional view taken along the line 3—3 in FIG. 1.

DESCRIPTION OF THE INVENTION

Figure 4:
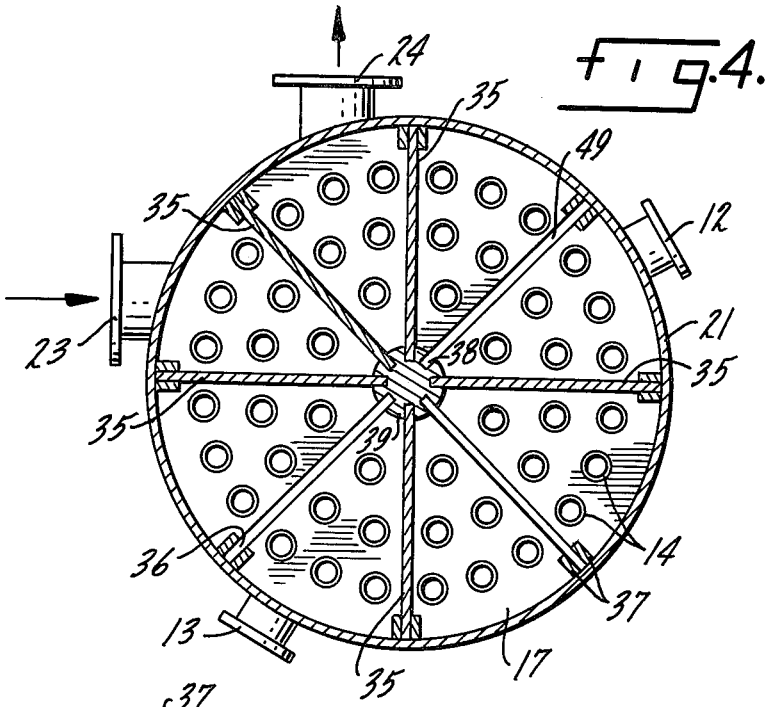
FIG. 4 is a cross sectional view corresponding to FIG. 2, but showing a different number of baffles.

The drawing shows a heat exchanger 10 in which the number of times the fluid being heated passes therethrough can be quickly and easily varied. A heat exchange fluid, such as steam, enters cylindrical container 11 through an inlet 12 and exits through an outlet 13. A plurality of longitudinally extending hollow heat exchange tubes 14 are divided into groups and essentially evenly spaced throughout container 11. The upper end 16 of each tube is anchored in a first tube sheet 17, and the lower end 18 of each tube is anchored in a second tube sheet 19. A cylindrical header 21 at the top of container 11 is defined in part by tube sheet 17, and a cylindrical header 22 at the bottom of container 11 is defined in part by tube sheet 19. Header 21 has an inlet 23 and an outlet 24 for the fluid being treated (e.g., radioactive waste liquid). A removable head 26 is affixed to flange 27 of container 11 by suitable means such as nuts and bolts (not shown) so as to seal against conventional gasket means 28, and in an identical way, gasket means 29 is sealed between a removable head 30 and flange 31.

Tubes 14 are arranged in a predetermined number of separated groups (e.g., eight as shown in the drawing) which establishes the maximum number of times the fluid being heated can be made to pass through container 11. The number of passes made by such fluid can be varied by changing the number and/or positions of removable flat baffle plates 35 in headers 21 and 22. Baffle plates 35 are identical in size and shape and are slidably received in channels 36, each of which is defined by a pair of longitudinally extending support bars 37 attached to the inside of a header. Plates 35 are also slidably received in slots 38 running the length of a pair of longitudinally extending cylindrical posts 39 and 40. One end 41 of post 39 is anchored to the center of tube sheet 17, and one end 42 of post 40 is anchored to the center of tube sheet 19. The other ends 44 and 45 of posts 39 and 40 are received in circular recesses 47 and 48 in the center of heads 26 and 30. One end of each plate 35 seats in a radially extending groove 49 in one of the tube sheets, and the other end of each plate 35 is held in a corresponding aligned groove 50 in the mating head. The grooves 50 in head 26 are at mirror image positions to grooves 49 in tube sheet 17, and the same is true of grooves 50 and 49 in head 30 and tube sheet 19. Each set of aligned grooves 49 and 50 and the associated channel 36 and aligned slot 38 capable of receiving the same plate 35 are in the same longitudinal plane. Such planes must be unobstructed by any tubes 14, and such planes should be spaced at equal radial cross sectional intervals (e.g., 45° ).

Figure 5:
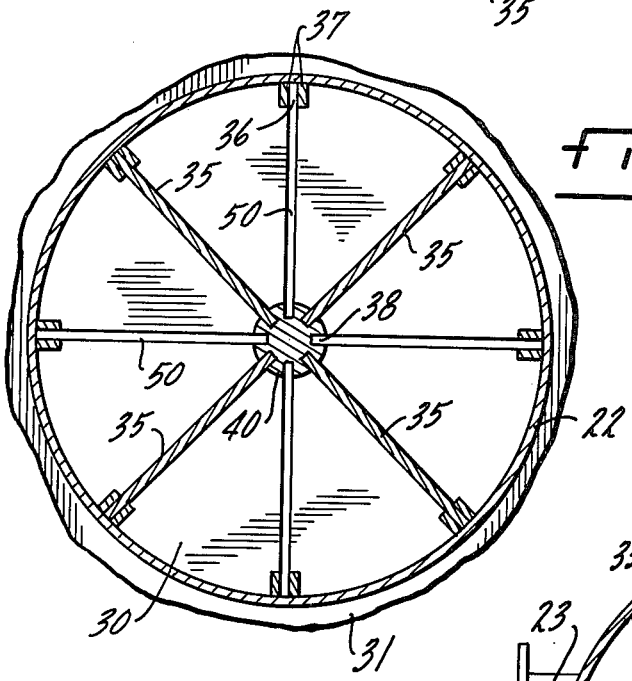
FIG. 5 is a cross sectional view corresponding to FIG. 3, but showing a different number of baffles.
Figure 6:
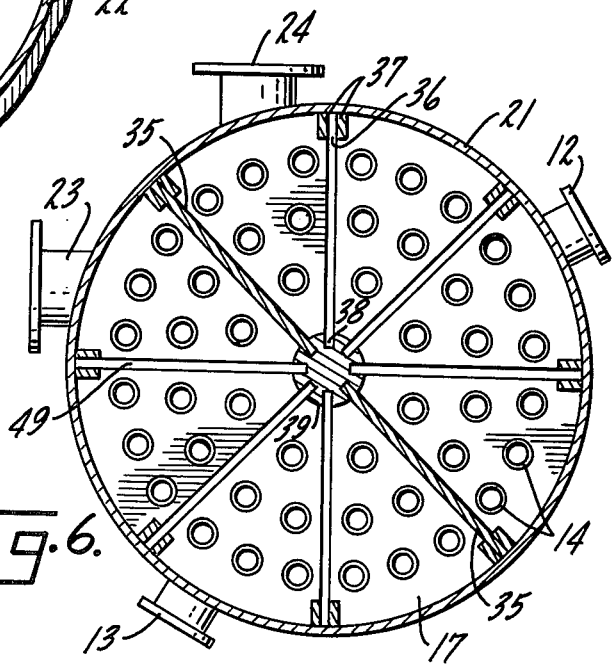
FIG. 6 is a cross sectional view corresponding to FIGS. 2 and 4, but showing a different number of baffles.

FIGS. 2 - 6 show how the number of passes the liquid makes through exchanger 10 can be quickly and easily doubled or halved. The plane including the slot 49 in the nine o'clock radial position will be designated 0°, the plane in the twelve o'clock radial position will be designated 90°, and so on proceeding clockwise around the cross section of headers 21 and 22. With baffle plates 35 occupying the 45°, 135° and 315° positions, shown in FIG. 2 and the 45° and 225° positions shown in FIG. 3, the liquid would make four passes through exchanger 10. Inlet 23 would be between the plates 35 in the 45° and 315° positions, and outlet 24 would be between the plates 35 in the 45° and 135° positions. The liquid wound enter header 21 through inlet 23 and then flow downwardly into header 22 through the tubes 14 occupying with additional objects and advantages thereof will be best understood from the following description of specific embodiments when read in connection with the accompanying drawings.

BRIEF DESCRIPTION OF THE DRAWINGS

FIG. 1 is a diagrammatical longitudinal section through a heat-exchanger in accordance with the present invention;

FIG. 2 is a section taken along line II—II of FIG. 1;

FIG. 3 is a partial sectional view and shows a gasket used in a portion of FIG. 1.

DESCRIPTION OF THE PREFERRED EMBODIMENTS

Referring to the drawing, in the pot-shaped double-shell casing 1 there is provided a removable insert 2. A stripper 3 can be brought into rotation via a mechanism 4 by an electromotor 5.

The double-shell casing 1 consists of an outer cylindrical drum 6, a casing bottom 7 and a hub part 8, to which the mechanism 4 is flanged and which is constructed as a casting together with the bottom of the casing. The latter is not represented on the diagram. Onto the bottom 7 of the casing, the drum 6, which is constructed in one piece with an inner bottom plate, is flanged - not shown in detail here. The drum encircles an outer cylindrical chamber for the cooling agent 12 and a disc-shaped cooling agent chamber 13 in the bottom 7. Both connecting chambers are accessible for cleaning by the removal of the drum 6.

At the free end of the double-shell casing 1, the inset 2 is mounted by means of a flange plate 18. It features two heat-exchanging double-shell parts 19 and 20 which are fixed concentrically to the drum 6. These parts in turn are detachably joined in the flange plate 18 and bind the cylindrical cooling agent chambers 21 and 22. In the inner compartment of the double-shell part 20, there is an annular pot 55 for cooling agents. The latter is connected to the open end of the insert by the frontal plate 24. In this way another annular chamber 56 for matter to be treated is created. For better cleaning purposes of the chambers for the matter, the double-shell part 20 at least must be fixed to the flange plate 18 so as to be removable.

Between the pot-shaped double-shell body 1, the inset 2 and the port for the cooling agent 55, three concentric annular chambers 36, 37 and 56 are thus formed and are linked consecutively. For this purpose, a gasekt 54 fixed to the spokes of the stripper is fitted between the bottom 7 of the casing and the open end of the inset 2. Here the matter flow from the inlet 43 through the annular chamber 36 and to the bottom chamber 38. From there it flows through the central annular chamber 37 to the flange plate 18. From here it is introduced by openings 57 in the double-shell part 20 into the inner annular chamber 56, and reaches through the latter out of the inner part of the bottom chamber 38, the outlet 39. The inlet as well as the outlet of the matter can be shaped by the deflection in such a manner, that a spiral movement of the matter is achieved at the concentric cylindrical heat-exchanging surfaces. All heat-exchaning surfaces can be exposed for cleaning by simply removing the inset. Shoule an even better accessibility to the heat-exchanging surfaces in the annular chambers for matter 37 and 56 be desired, one can remove the double-shell part 20 from the flange plate 18.

The stripper 3 is with its hub 45, wedged onto the power-take-off shaft of the power driven mechanism 4. A washer 46 fitted between this hub and the hub part 8, seals off the chambers from the mechanism. From the hub in the bottom chamber 38 spokes 47 protrude radially to the outside, on which are mounted scraping band 48, 49 for the frontal plate of the insert and the bottom surface of the bottom of the casing 7 or the bottom wall 1, respectively.

Fixed to the spokes 47, arranged in a 90° division, are longer stripper branches 50 as well as shorter ones 51. These protrude axially in opposite pairs into the annular chamber, and carry according to FIG. 1, longitudinally directed and staggered scraping bands 52 for the inner heat-exchanging surfaces; these scraping bands extend over half the length of the heat-exchanging surfaces. Scraping bands 53 for the outside heat-exchanging surfaces are fixed to the stripper branches 50 so that they are arranged at an angle of 90° to the bands 52. The adjustment of these scraping bands is wedge-shaped at angles between some 35° and 50° forward with regard to the direction of rotation. They are formed elastically to the effect that by action of elastic power, they scrape all eliminated parts of the processed material off the heat-exchanging surface and in addition, direct the matter immediately towards the opposite heat-exchanging surface as illustrated by the arrangement of circular arrows in FIG. 2. The scraper bands are screwed onto the stripper branches through slot holes and are thus adjustable. The force of pressure, thereby, can be regulated smoothly and continuously conforming to the needs of the product.

Moving from the inlet for cooling agents through tubes 58 and inlet pipes 59, the agent reaches the end of the annular chambers for cooling agents as on the left hand of FIG. 1. After tangential introduction it is discharged there at the end on the right (not shown on the diagram), and conducted through tubes 60 to the outlet for cooling agents 17.

The chambers for cooling agents are separated here by altogether eight cylindrical heat-transfer surfaces, six of which are utilized for heat transfer. This means, that only the external cylindrical surface requires insulation. The loss of heat is therefore considerably reduced.

The same arrangement can always be applied without alterations, if instead of a cooling agent a heating agent is conducted through, i.e., if the matter is to be heated. If several units are in operation, some of which are run with cooling, and some with heating agents, one can largely do without the external addition or dispersion of heat. If necessary, the units can be run in a complete cycle.

Without further analysis, the foregoing will so fully reveal the gist of the present invention that others can, by applying curent knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A heat exchanger, in particular a scraping cooling arrangement for fluid matter tending to adhere to the heat-exchanging surface comprising: a pot-shaped casing; and endplate sealing said casing, said casing concentrically interchanging heat-exchanging parts with heat-exchanging agent flowing therethrough; at least isolated groups of tubes having their openings segregated so that all of said second fluid passes through each such isolated group of tubes, a removable head on at least one of said headers, there being radially extending grooves in said head and radially extending grooves aligned therewith in the tube sheet associated with said one header receiving said baffles, the space between said grooves in said head and tube sheet being unobstructed by any tubes, longitudinally extending support bars on the inside of said one header defining a channel for receiving one edge of each of said baffles, and a longitudinally extending post anchored to the center of said tube sheet, there being a plurality of radially extending slots in said post aligned with said channels for receiving the other edge of each of said baffles, the space between said slots and channels being unobstructed by any tubes, and there being a recess in the center of said removable head for receiving the unanchored end of said post.

7. A variable pass heat exchanger of circular cross-section comprising a container enclosing a plurality of separated groups of longitudinally extending heat exchange tubes anchored at each of their ends in separate tube sheets, a header at each end of said container defined in part by one of said tube sheets, an inlet and an outlet in said container for a heat exchange fluid, an inlet and an outlet in one of said headers for a liquid to be brought into heat exchange relationship with said heat exchange fluid, a removable head on each of said headers, there being radially extending grooves in said heads and radially extending grooves aligned therewith in the tube sheet associated with each of said heads, pairs of longitudinally extending support bars on the inside of each of said headers defining a plurality of channels aligned with said grooves, a pair of longitudinally extending cylindrical posts each having one of its ends anchored to the center of one of said tube sheets, there being a plurality of radially extending slots in each post, said channels being aligned with said slots, there being a recess in the center of each removable head for receiving the unanchored end of one of said posts, corresponding sets of grooves, slots and channels being aligned in the same plane with the space defined by such planes being unobstructed by any tubes, a plurality of longitudinally extending, removable, identical flat baffle plates slidably received in corresponding sets of aligned grooves, slots and channels in at least said one header for dividing said separated groups of tubes into a variable number of isolated groups of tubes having their openings segregated so that all of said liquid passes through each such isolated group of tubes, and said inlet and said outlet for said liquid being isolated from each other by said baffle plates.

8. The invention defined in claim 7, wherein there are eight sets of aligned grooves, slots and channels in each header, and the planes of said sets are equally spaced at 45° radial cross sectional intervals.

9. The invention defined in claim 8, wherein baffle plates occupy the radial positions corresponding to 0°, 45°, 90°, 180° and 270° in one header with said inlet being between the baffle plates at the 0° and 45° positions and said outlet being between the baffle plates at the 45° and 90° positions, and the baffle plates in the other header occupy the radial positions corresponding to 45°, 135°, 225° and 315°, whereby said liquid makes eight passes through said heat exchanger.

10. The invention defined in claim 8, wherein baffle plates occupy the radial positions corresponding to 45°, 135°, and 315° in one header with said inlet being between the baffle plates at the 45° and 315° positions and said outlet being between the baffle plates at the 45° and 135° positions, and the baffle plates in the other header occupying the radial positions corresponding to 45° and 225°, whereby said liquid makes four passes through said heat exchanger.

11. The invention defined in claim 8, wherein baffle plates occupy the radial positions corresponding to 45° and 225° in said one header with said inlet and outlet being separated by said baffle plates, and there are no baffle plates in the other header.

* * * * *

UNITED STATES PATENT AND TRADEMARK OFFICE

CERTIFICATE OF CORRECTION

PATENT NO. : 4,105,065

DATED : August 8, 1978

INVENTOR(S) : Anthony Nicholas Chirico

It is certified that error appears in the above-identified patent and that said Letters Patent are hereby corrected as shown below:

In column 2, line 66 delete "wound" and insert --would--

In column 4, line 4 delete "exchanger" and insert --exchange--

In column 4, line 37 delete "exchanger" and insert --exchange--

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*